US007535317B2

(12) United States Patent
Wild et al.

(10) Patent No.: US 7,535,317 B2
(45) Date of Patent: May 19, 2009

(54) COAXIAL CHARACTERISTIC-IMPEDANCE TRANSFORMER HAVING CONCENTRIC QUARTER WAVELENGTH LINES CONFIGURED AS A POWER DIVIDER

(75) Inventors: Werner Wild, Unterthurheim (DE); Jurgen Breidbach, Kirchheim (DE)

(73) Assignee: Spinner GmbH, Munich (DE)

( * ) Notice: Subject to any disclaimer, the term of this patent is extended or adjusted under 35 U.S.C. 154(b) by 203 days.

(21) Appl. No.: 11/615,524

(22) Filed: Dec. 22, 2006

(65) Prior Publication Data

US 2007/0164836 A1 Jul. 19, 2007

(30) Foreign Application Priority Data

Dec. 22, 2005 (DE) ..... 10 2005 061 671

(51) Int. Cl.
*H01P 5/12* (2006.01)
*H01P 5/02* (2006.01)

(52) U.S. Cl. ..... 333/125; 333/127; 333/35; 333/34

(58) Field of Classification Search ..... 333/125, 333/127, 35, 34
See application file for complete search history.

(56) References Cited

U.S. PATENT DOCUMENTS

| | | | | |
|---|---|---|---|---|
| 2,643,296 | A * | 6/1953 | Hansen | 333/127 |
| 3,019,399 | A | 1/1962 | Lanciani et al. | |
| 3,087,129 | A | 4/1963 | Maury et al. | |
| 4,035,746 | A * | 7/1977 | Covington, Jr. | 333/127 |
| 5,410,281 | A | 4/1995 | Blum | |

FOREIGN PATENT DOCUMENTS

JP 61072401 A 4/1986

OTHER PUBLICATIONS

Iginio Longo et al., "A Coaxial Antenna With Miniaturized Choke for Minimally Invasive Interstitial Heating," IEEE Transactions on Biomedical Engineering, vol. 50, No. 1, Jan. 2003, IEEE Service Center, Piscataway, NJ.

* cited by examiner

*Primary Examiner*—Benny Lee
(74) *Attorney, Agent, or Firm*—Edell, Shapiro & Finnan, LLC

(57) ABSTRACT

A coaxial characteristic-impedance transformer for dividing RF power on a first terminal onto n second terminals situated in the same radial plane by multi-stage serial transformation via λ/4 lines is provided with a short overall size, where the λ/4 lines between the first connection and the second connections are at least partly disposed to surround each other concentrically.

11 Claims, 7 Drawing Sheets

COAXIAL CHARACTERISTIC-IMPEDANCE TRANSFORMER HAVING CONCENTRIC QUARTER WAVELENGTH LINES CONFIGURED AS A POWER DIVIDER

CROSS REFERENCE TO RELATED APPLICATIONS

This application claims priority under 35 U.S.C. §119 to Application No. DE 102005061671.2 filed on Dec. 22, 2005, entitled "Coaxial Characteristic-Impedance Transformer," the entire contents of which are hereby incorporated by reference.

FIELD OF THE INVENTION

The invention relates to a coaxial characteristic-impedance transformer for dividing RF power on a first terminal onto n, where ($n \geqq 2$), second terminals situated in the same radial plane by multi-stage serial transformation by means of λ/4 lines.

BACKGROUND

Known characteristic-impedance transformers are used for evenly dividing in a matched and thus reflection-free manner RF energy supplied via an incoming coaxial line among two or more outgoing coaxial lines having the same characteristic-impedance as the incoming coaxial line, which as a rule is 50Ω. Such characteristic-impedance transformers are also known as distributors or splitters. They usually comprise several transformation stages, each of which includes a coaxial line section having a mechanical length of approximately λ/4 (λis the wavelength of the operating or center frequency). A software known as APLAC®, which is available on the market from AWR Corp (El Segundo, Calif.), can be used for calculating the precise length and the diameter of an inside conductor and an outside conductor of the line sections. For reasons of brevity, the individual line sections will therefore be referred to below and in the claims as λ/4 lines.

In principle, a characteristic-impedance transformer should be as free as possible from reflections, i.e., it should have a low VSWR (voltage standing wave ratio), especially at the first terminal. However, VSWR values that are acceptable at adequate bandwidth require at least three transformation stages, and four or more stages when large bandwidths are required simultaneously. Since the transforming line sections are disposed in series, not only electrically but also mechanically, known characteristic-impedance transformers are constructed to be of a large length. Their (theoretical) length is at a minimum equal to n·λ/4, i.e., proportional to the number n of the transformation stages.

SUMMARY OF THE INVENTION

The λ/4 lines between the first terminal and the second terminals are at least partly disposed to surround each other concentrically, which allows for shorter lengths of the characteristic-impedance transformer. According to the invention, the outside conductor of the first λ/4 line at least along a part of its length is used as the inside conductor of the second λ/4 line, and the outside conductor thereof in turn is used as the inside conductor of the third λ/4 line, etc. This makes possible embodiments of the characteristic-impedance transformer with a short overall length.

In particular, the λ/4 lines can be arranged concentrically with respect to each other such that the open end of one λ/4 line forms the beginning of the subsequent, i.e., successive, λ/4 line.

When the λ/4 lines are arranged concentrically with respect to each other in such a way that an electromagnetic wave propagates from one λ/4 line to another λ/4 line in an opposite direction, the (theoretical) length of the characteristic-impedance transformer thus will not be substantially larger than λ/4 (irrespective of the number of stages), as long as supplementary compensation, to increase the bandwidth, is avoided.

An increase of the number of stages without substantial enlargement of the diameter of the characteristic-impedance transformer can be achieved when at least one of the λ/4 lines is folded such that a part of its length concentrically surrounds the remaining part of its length. In this embodiment, an electromagnetic wave therefore propagates in at least one of the transformation stages, i.e., a corresponding line section having a length of approximately λ/4, within a first volume in one direction, and in an opposite direction within a second volume surrounding the first volume.

A compact four-stage characteristic-impedance transformer which has an overall length only slightly longer than, for example, a three-stage embodiment, but which can have the same diameter, will be obtained provided that an inside conductor of a first stage has a first diameter and forms, together with an outside conductor of the first stage, a first λ/4 line; that an extension of this inside conductor having a second, larger diameter forms, together with an inner jacket surface of the same outside conductor, a first section of a second stage, a second section of which consists of an outer jacket surface of the outside conductor, having a first outside diameter, of the first stage as a second inside conductor, together with an inside jacket surface of a surrounding hollow cylinder as a second outside conductor; that a section of the outside conductor having a second, larger outside diameter is contiguous to this second stage as an inside conductor, which together with an inside jacket surface of the surrounding hollow cylinder, forms a first section of a third stage, a second section of which includes an outside jacket surface of the surrounding hollow cylinder, having a first outside diameter, as a third inside conductor, together with an inside jacket surface of a hollow-cylindrical housing, to which a fourth stage is contiguous that includes a second section of the surrounding hollow cylinder, having a second, larger outer diameter, as a fourth inside conductor, together with the inner jacket surface of the hollow cylindrical housing as an outside conductor, the surrounding hollow cylinder being connected to inside conductors of the second terminals. A folding of the second and third stage, as effected in this manner, thereby avoids the necessity of enlarging the diameter of the housing in order to accommodate the fourth stage, which would lead to a lowering of the limiting frequency.

A larger bandwidth and a more uniform variation of the reflectance factor in dependence upon the frequency can be achieved when the inside conductor of the first terminal comprises an inside conductor that is designed to be a compensating λ/4 open-circuit line, and is accommodated concentrically and in an insulated condition within the inside conductor of the first λ/4 line.

Another improvement for the same purpose is achieved when the inside conductor of a compensating λ/4 short-circuit line is connected to a junction of the inside conductors of the second terminals.

The above and still further features and advantages of the coaxial characteristic-impedance transformer will become apparent upon consideration of the following definitions, descriptions and descriptive figures of specific embodiments thereof, wherein like reference numerals in the various figures are utilized to designate like components. While these descriptions go into specific details of the device, it should be understood that variations may and do exist and would be apparent to those skilled in the art based on the descriptions herein.

BRIEF DESCRIPTION OF THE DRAWINGS

The characteristic-impedance transformer in accordance with the invention is explained below with reference to the drawings which relate to schematically simplified examples of embodiment and supplementary diagrams, wherein.

Like reference numerals have been used to identify like elements throughout this disclosure.

DETAILED DESCRIPTION OF THE PREFERRED EMBODIMENTS

In the following paragraphs, exemplary embodiments of the device are described in connection with the figures.

Figure 1:
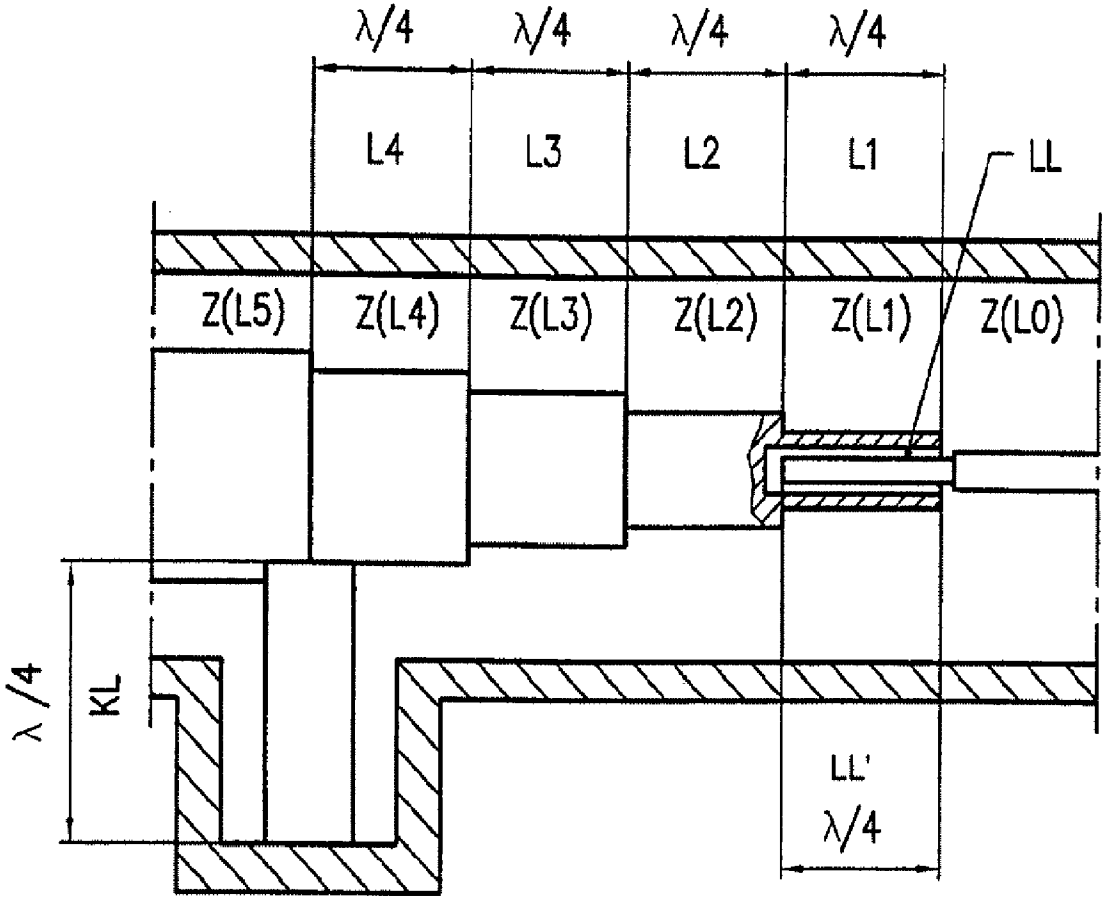
FIG. 1 shows the principle, as known per se, of a coaxial characteristic-impedance transformer.

FIG. 1 shows the known principle of a four-stage characteristic-impedance transformer for transforming or matching a low characteristic-impedance Z(L5) to a higher characteristic-impedance Z(L0) via four successive line sections L1, L2, L3, and L4 of approximately λ/4 length with corresponding characteristic-impedances Z(L1), Z(L2), Z(L3), and Z(L4) that decrease stage-by-stage. For increasing the bandwidth and for smoothing the course of the reflectance factor in dependence upon frequency, a λ/4 open-circuit line LL, LL' is additionally incorporated into the first stage L1, and a λ/4 short-circuit line KL is connected to the end of the fourth stage L4. The characteristic-impedance Z(L5) which is lower in comparison with Z(L0) arises in the case of a power distributor or splitter owing to coaxial lines (not shown) which are connected in parallel to the last transformation stage L4, and which are, for example, the feed lines of a corresponding number of antennas.

Figure 2:
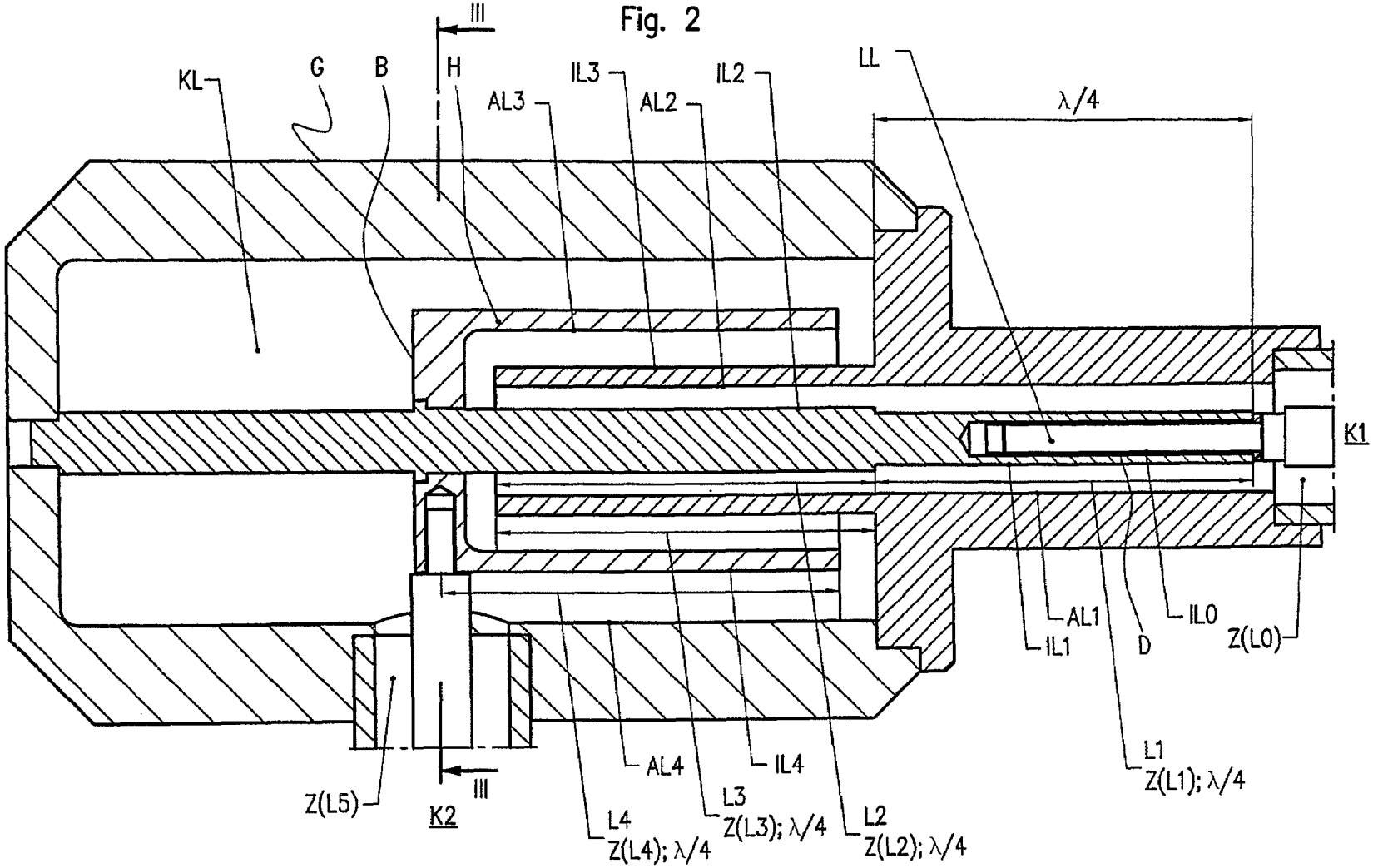
FIG. 2 shows a longitudinal section of a four-stage implementation of the characteristic-impedance transformer according to an exemplary embodiment of the invention.
Figure 3:
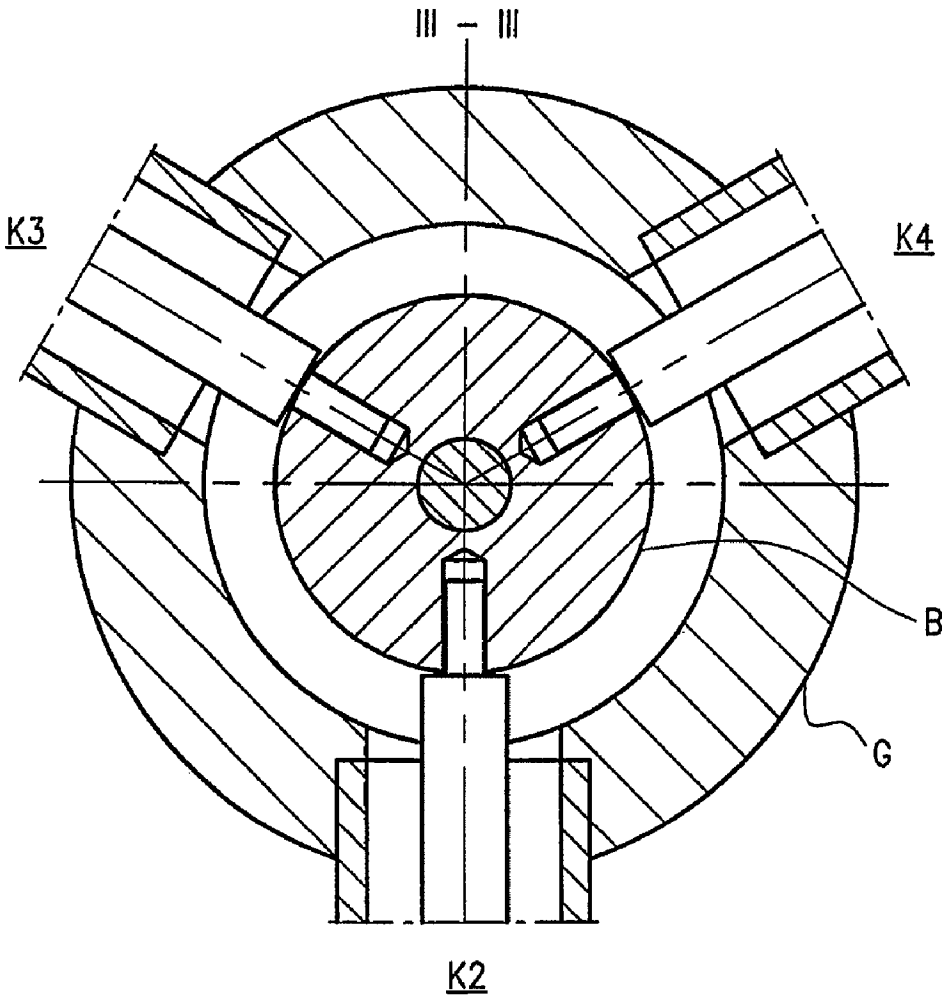
FIG. 3 shows a cross-section corresponding to the line III-III in FIG. 2.

FIGS. 2 and 3 respectively show a longitudinal section and a cross section along the line Ill-Ill in FIG. 2 of a four-stage characteristic-impedance transformer for uniformly distributing RF power supplied via a coaxial line to a first terminal K1 to three second terminals K2, K3, and K4. As seen in to FIG. 2, an inside conductor IL1 and an outside conductor AL1 jointly form a first transformation stage L1 having a characteristic-impedance Z(L1) and a length of approximately λ/4. The outside diameter of IL1 and the inside diameter of AL1, and also the precise length, can be calculated, as can be also the respective sizes of the subsequent transformation stages, via the aforementioned software sold under the trade name APLAC®. The inside diameter IL1 on its part concentrically accommodates an inside conductor IL0 which in combination with the inner jacket surface of the inside conductor IL1 and a dielectric D forms an open circuit line LL that is slightly shorter than λ/4 and serves, as in the case of FIG. 1, for frequency response compensation. A second stage L2 having the characteristic-impedance Z(L2) is contiguous to this first stage L1. While their outside conductors AL2 and AL1 have the same inside diameters, the inside conductor IL2 has a larger outer diameter than IL1 in order to achieve a Z(L2) that is comparatively smaller than Z(L1).

The open end of the outside conductor AL2 of stage L2 is likewise the beginning of the stage L3 with the even lower characteristic-impedance Z(L3). This stage L3 uses as an inside conductor IL3, in other words, the outer jacket surface of the outside conductor AL3, and as an outside conductor the inner jacket surface of a cup-shaped hollow cylinder H which surrounds the stage L2. The open end of the cylinder H forms the end of stage L3 in analogy to the configuration of stage L2, and the beginning of the stage L4 with the even lower characteristic-impedance Z(L4). The RF power accordingly changes its direction of propagation at the open end of the outside conductor AL2 and at the open end of the hollow cylinder H. An outer jacket surface of the hollow cylinder H forms an inside conductor IL4 of the stage L4, and an inner jacket surface of a housing G of the characteristic-impedance transformer forms its outside conductor AL4. At the end of stage L4, the RF power is distributed uniformly onto the second terminals K2 to K4, the inside conductors of which contact a floor B which seals off one end of the hollow cylinder H.

For further frequency response compensation, the housing G is extended beyond the region of the terminals K2 to K4 and forms, jointly with a coaxial extension of the inside conductor IL2 through the floor B of the hollow cylinder H, a short-circuit line KL which has a length of approximately λ/4, again in analogy with the corresponding short-circuit line in the schematic diagram of FIG. 1.

In the case of lower demands made on the bandwidth, it is possible to omit the short-circuit line KL and/or the open-circuit line LL. When the short-circuit line KL can be omitted within this sense, the characteristic-impedance transformer has an even considerably shorter overall size.

Figure 4:
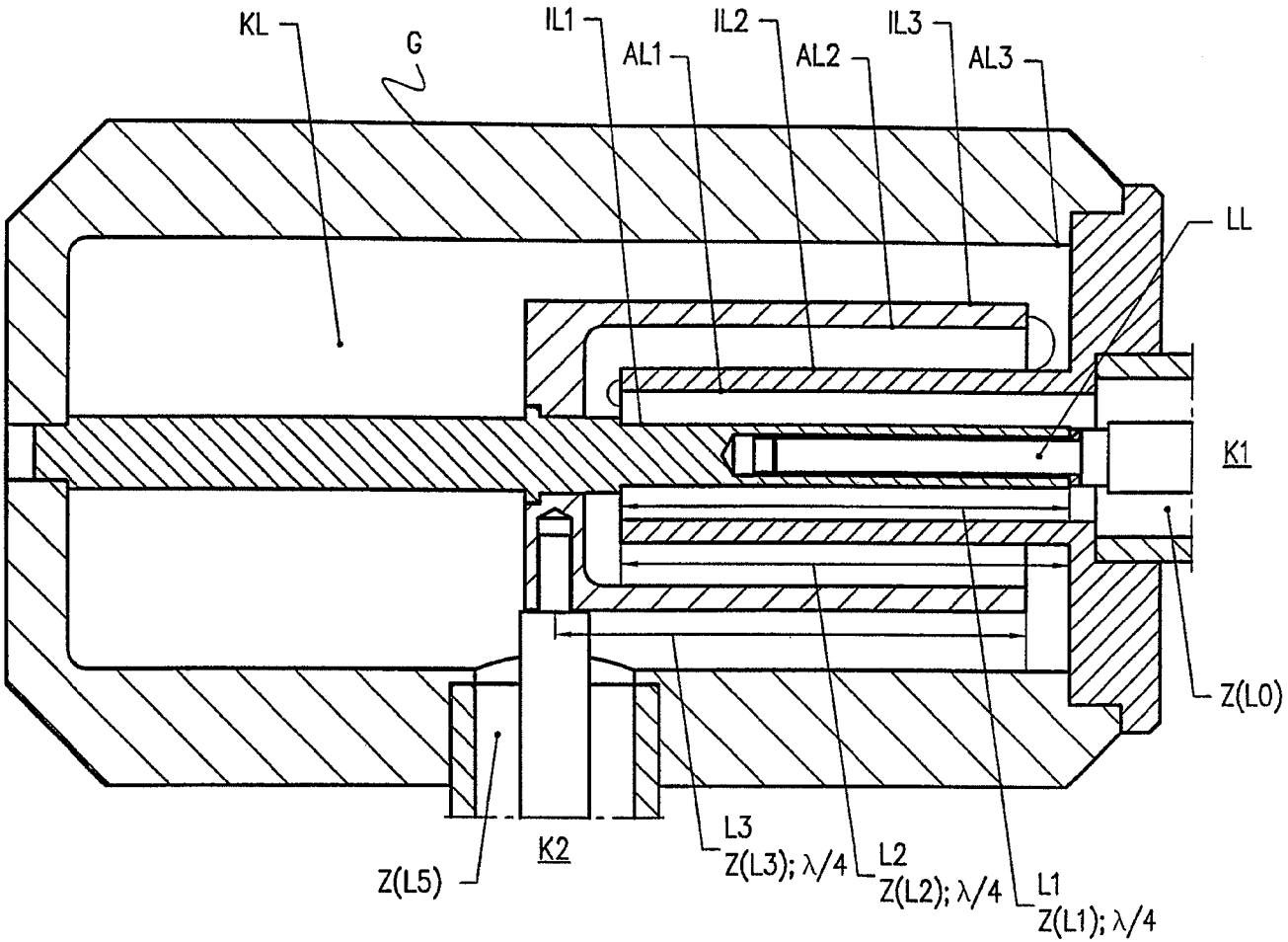
FIG. 4 shows a longitudinal section of a three-stage embodiment of the invention.

FIG. 4 shows a three-stage embodiment of the characteristic-impedance transformer. The same reference numerals as used in FIG. 2 apply. The housing G has the same diameter as the housing G in FIG. 2, so that the limiting wavelength is the same for both embodiments (undesirable wave modes of higher order occur in coaxial systems beyond the limiting wavelength determined approximately by the inside diameter of the housing). The three-stage embodiment according to FIG. 4 differs from the four-stage embodiment according to FIG. 2 in principle only in that, due to the omission of the fourth stage, sufficient space is available for also accommodating the first stage L1 including the open-circuit line LL in the housing G. As a result, not only all stages L1 to L3 and therewith the λ/4 lines forming them, but also the compensating line KL are concentrically nested within each other.

Figure 5:
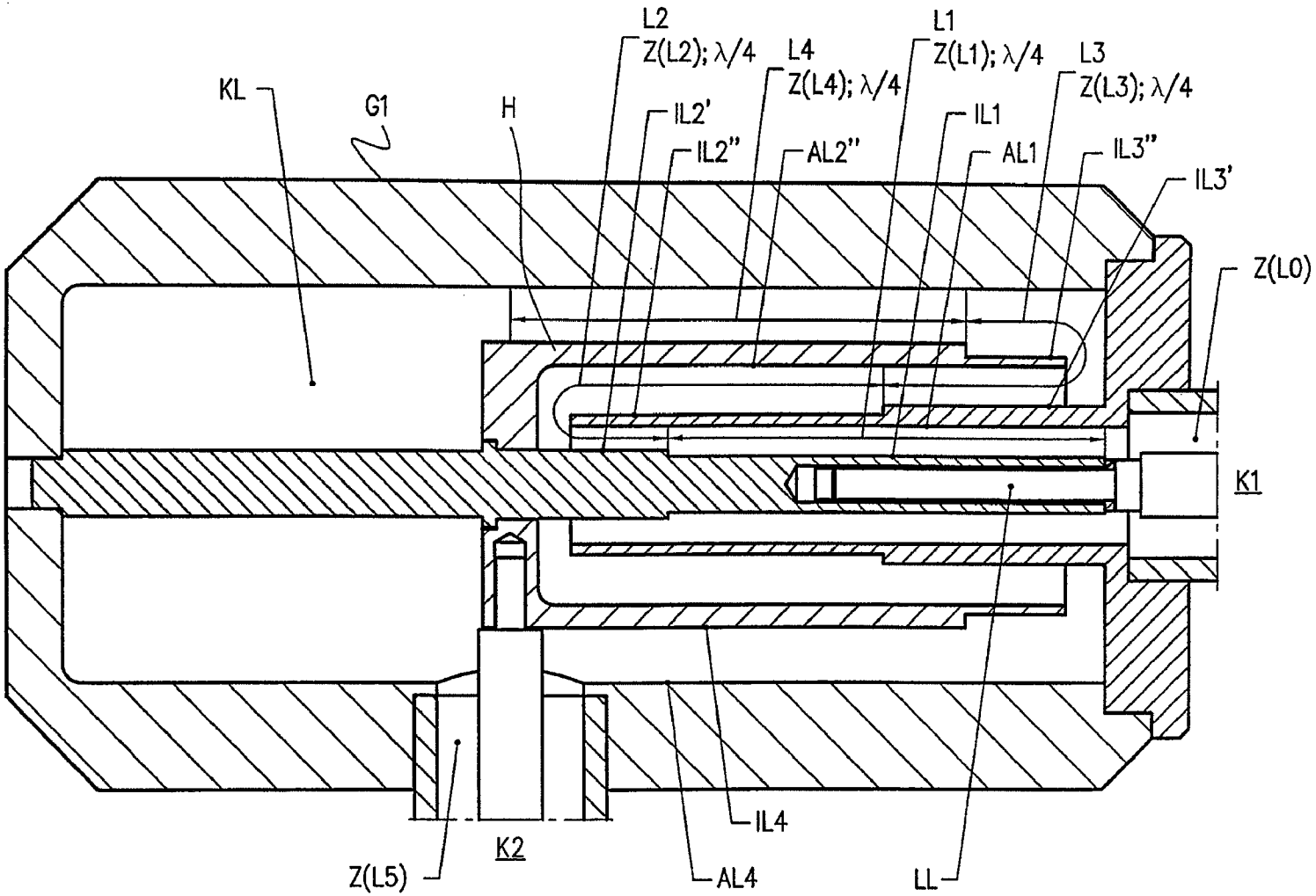
FIG. 5 shows a longitudinal section of another four-stage embodiment of the invention.

FIG. 5 shows an embodiment similar to FIG. 4 with the same or corresponding reference numerals, but with four transformation stages L1, L2, L3, and L4. In order to enable the four stages L1, L2, L3, and L4 to be accommodated within a housing G1 which has the same inside diameter as the housing G in FIG. 4, not only are the stages L1, L2, L3, and L4 nested concentrically within each other in this embodiment, but the stages L2 and L3 are additionally folded. The stage L2 thus has a first inside conductor section IL2' which has a larger outside diameter than the inside conductor IL1 of the first stage L1. The second inside conductor section IL2" comprises the outer jacket surface of the second (extended) outside conductor AL2" of the first stage L1. This jacket surface has a larger outside diameter at the beginning of the third stage L3 than in the region of IL2", and thus forms the first section IL3' of the third stage L3. The second section IL3" forms the outer jacket surface of the hollow cylinder H having a first diameter. Contiguous to this is the stage L4 which is configured like the stage L4 in the embodiment according to FIG. 2.

Figure 6:
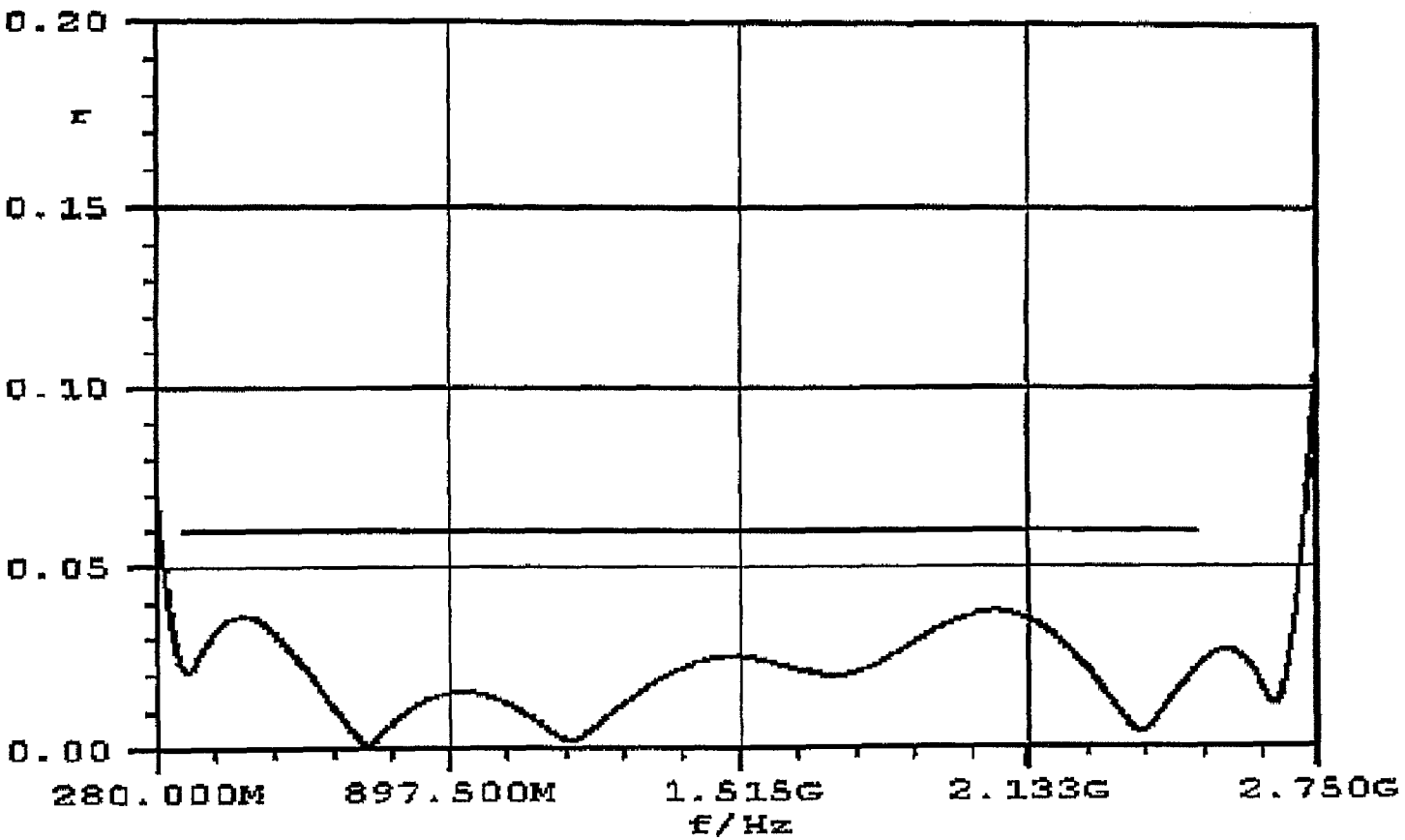
FIG. 6 shows the frequency-dependent course of the reflectance factor of the four-stage characteristic-impedance transformer according to FIG. 5.

The diagram in FIG. 6 shows the frequency-dependent course of the reflectance factor of the characteristic-impedance transformer vs. frequency in Hz in the embodiment according to FIG. 5.

Figure 7:
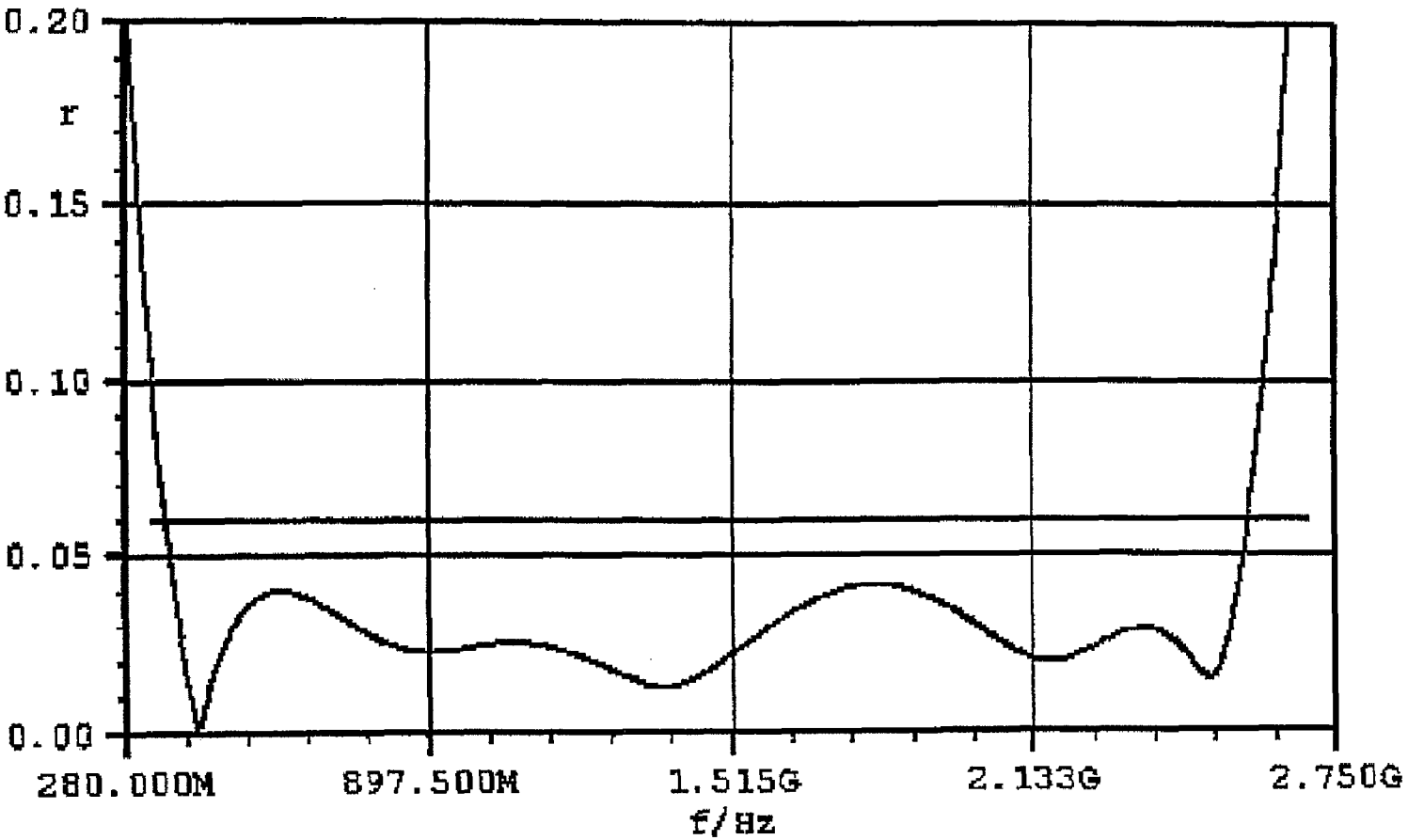
FIG. 7 shows the frequency-dependent course of the reflectance factor of the three-stage characteristic-impedance transformer according to FIG. 4.

The diagram in FIG. 7 shows the frequency-dependent course of the reflectance factor for the three-stage characteristic-impedance transformer vs. frequency in Hz according to FIG. 4. A comparison of the two diagrams shows that the three-stage characteristic-impedance transformer has a large bandwidth of approximately 370 to 2,560 MHz in which the reflectance factor remains below 0.06, but that in the case of a four-stage configuration this bandwidth further increases to 280 to 2,700 MHz.

While the coaxial characteristic-impedance transformer has been described in detail with reference to specific embodiments thereof, it will be apparent to one of ordinary skill in the art that various changes and modifications can be made therein without departing from the spirit and scope thereof. Accordingly, it is intended that the described device covers the modifications and variations of this coaxial characteristic-impedance transformer provided they come within the scope of the appended claims and their equivalents.

What is claimed is:

1. A coaxial characteristic-impedance transformer comprising:

a first terminal disposed in an axial direction;

a plurality of second terminals situated in a common radial plane; and a plurality of λ/4 lines coupling the first terminal to the second terminals, the transformer being configured to divide RF power on the first terminal onto the second terminals by multi-stage serial transformation via the λ/4 lines, wherein the λ/4 lines are at least partly disposed to surround each other concentrically, wherein an inside conductor of the first terminal is followed by an inside conductor operable as a compensating λ/4 open-circuit line and disposed concentrically within and insulated from an inside conductor of a first of the plurality of λ4 lines.

2. The characteristic-impedance transformer according to claim 1, wherein the plurality of λ/4 lines are disposed concentrically with respect to each other such that a respective open end of a corresponding λ/4 line forms a beginning of a successive λ/4 line.

3. The characteristic-impedance transformer according to claim 1, wherein the plurality of λ/4 lines are disposed concentrically with respect to each other such that an electromagnetic wave propagates from one λ/4 line to another λ/4 line in an opposite direction.

4. The characteristic-impedance transformer according to claim 1, wherein at least one of the plurality of λ/4 lines is folded such that one part of the at least one λ/4 line's length concentrically surrounds a remaining part of the at least one λ/4 line's length.

5. The characteristic-impedance transformer according to claim 4, further comprising:

an inside conductor including a first portion with a first outer surface and a second portion with a second outer surface with a larger diameter than the first outer surface;

an outside conductor arranged concentrically around the inside conductor, the outside conductor having an inner surface and including a first portion with a first outer surface and a second portion with a second outer surface with a larger diameter than the first outer surface of the outside conductor;

a hollow cylinder arranged concentrically around the outside conductor, the hollow cylinder having an inner surface and including a first portion with a first outer surface and a second portion with a second outer surface with a larger diameter than the first outer surface of the hollow cylinder; and a hollow cylindrical housing arranged concentrically around the hollow cylinder and having an inner surface, wherein:

the first portion of the inside conductor and the inner surface of the outside conductor form a first λ/4 line of the plurality of λ/4 lines;

the second portion of the inside conductor and the inner surface of the outside conductor form a first section of a second λ/4 line of the plurality of λ/4 lines;

the first portion of the outside conductor and the inner surface of the hollow cylinder form a second section of the section of the second λ/4 line;

the second portion of the outside conductor and the inner surface of the hollow cylinder form a first section of a third λ/4 line of the plurality of λ/4 lines;

the first portion of the hollow cylinder and the inner surface of the hollow cylindrical housing form a second section of the third λ/4 line;

the second portion of the hollow cylinder and the inner surface of the hollow cylindrical housing form a fourth λ/4 line of the plurality of λ/4 lines; and wherein the hollow cylinder is connected to inside conductors of the plurality of second terminals.

6. The characteristic-impedance transformer according to claim 1, wherein:

the second terminals include inside conductors;and an inside conductor of a compensating λ/4 short-circuit line is connected to a junction of inside conductors of the second terminals.

7. A coaxial characteristic-impedance transformer comprising:

a first terminal disposed in an axial direction;

a plurality of second terminals situated in a common radial plane;

a plurality of λ/4 lines coupling the first terminal to the second terminals, the transformer being configured to divide RF power on the first terminal onto the second terminals by multi-stage serial transformation via the λ/4 lines, wherein the λ/4 lines are at least partly disposed to surround each other concentrically;

an inside conductor including a first portion with a first outer surface and a second portion with a second outer surface with a larger diameter than the first outer surface;

an outside conductor arranged concentrically around the inside conductor, the outside conductor having an inner surface and including a first portion with a first outer surface and a second portion with a second outer surface with a larger diameter than the first outer surface of the outside conductor;

a hollow cylinder arranged concentrically around the outside conductor, the hollow cylinder having an inner surface and including a first portion with a first outer surface and a second portion with a second outer surface with a larger diameter than the first outer surface of the hollow cylinder; and a hollow cylindrical housing arranged concentrically around the hollow cylinder and having an inner surface, wherein:

the first portion of the inside conductor and the inner surface of the outside conductor form a first λ/4 line of the plurality of λ/4 lines, the second portion of the inside conductor and the inner surface of the outside conductor form a first section of a second λ/4 line of the plurality of λ/4 lines, the first portion of the outside conductor and the inner surface of the hollow cylinder form a second section of the section of the second λ/4 line, the second portion of the outside conductor and the inner surface of the hollow cylinder form a first section of a third λ/4 line of the plurality of λ/4 lines, the first portion of the hollow cylinder and the inner surface of the hollow cylindrical housing form a second section of the third λ/4 line, the second portion of the hollow cylinder and the inner surface of the hollow cylindrical housing form a fourth λ/4 line of the plurality of λ/4 lines, and wherein the hollow cylinder is connected to inside conductors of the plurality of second terminals, wherein at least one of the plurality of λ/4 lines is folded such that one part of the at least one λ/4 line's length concentrically surrounds a remaining part of the at least one λ/4 line's length.

8. The characteristic-impedance transformer according to claim 7, wherein:

the second terminals include inside conductors; and an inside conductor of a compensating λ/4 short-circuit line is connected to a junction of inside conductors of the second terminals.

9. The characteristic-impedance transformer according to claim 7, wherein the plurality of λ/4 lines are disposed concentrically with respect to each other such that a respective open end of a corresponding λ/4 line forms a beginning of a successive λ/4 line.

10. The characteristic-impedance transformer according to claim 7, wherein the plurality of λ/4 lines are disposed concentrically with respect to each other such that an electromagnetic wave propagates from one λ/4 line to another λ/4 line in an opposite direction.

11. The characteristic-impedance transformer according to claim 7, wherein an inside conductor of the first terminal is followed by an inside conductor operable as a compensating λ/4 open-circuit line and disposed concentrically within and insulated from an inside conductor of a first of the plurality of λ/4 lines.

* * * * *

UNITED STATES PATENT AND TRADEMARK OFFICE

CERTIFICATE OF CORRECTION

PATENT NO. : 7,535,317 B2
APPLICATION NO. : 11/615524
DATED : May 19, 2009
INVENTOR(S) : Wild et al.

It is certified that error appears in the above-identified patent and that said Letters Patent is hereby corrected as shown below:

Column 1, after line 57, insert the following paragraph -- The described device relates to a coaxial characteristic-impedance transformer for dividing RF power on a first terminal onto n second terminals situated in the same radial plane ($n \geq 2$) by multi-stage serial transformation via $\lambda/4$ lines. The described device is a characteristic-impedance transformer with a substantially short length without impaired electrical characteristics. --; and Column 3, line 59, replace "I11-I11" with -- III-III --.

Signed and Sealed this

Eighteenth Day of August, 2009

David J. Kappos

David J. Kappos
*Director of the United States Patent and Trademark Office*